US005150751A

United States Patent [19]

Burton et al.

[11] Patent Number: 5,150,751

[45] Date of Patent: Sep. 29, 1992

[54] STUFFING BOX LEAK CONTAINMENT APPARATUS

[75] Inventors: Anthony R. Burton; Monte K. Mitchell; Raymond Hernandez, all of Andrews, Tex.

[73] Assignee: Atlantic Richfield Company, Los Angeles, Calif.

[21] Appl. No.: 736,840

[22] Filed: Jul. 29, 1991

[51] Int. Cl.[5] ..... E21B 33/08

[52] U.S. Cl. ..... 166/81; 166/84; 166/93

[58] Field of Search ..... 166/81, 82, 84, 93

[56] References Cited

U.S. PATENT DOCUMENTS 2,513,714 7/1950 Cordes ..... 166/81
3,186,722 6/1965 Johnston ..... 166/84
3,270,810 9/1966 Johnston ..... 166/84
3,322,198 5/1967 McHenry ..... 166/81
4,542,787 9/1985 Parker .

*Primary Examiner*—Terry Lee Melius
*Attorney, Agent, or Firm*—Roderick W. MacDonald

[57] ABSTRACT

Apparatus for containing and collecting leaks from the stuffing box of a fluid producing wellhead comprising collection means carried by the wellhead below the stuffing box and encircling the wellhead and at least two separate upstanding hollow shapes of such cross-sectional configuration that when they are brought into abutment with one another the volume enclosed within abutting shapes encircles the wellhead and extends from the liquid collection means to above the stuffing box, said shapes having apertured top edge means which form an opening that encircles the polished rod that reciprocates through the stuffing box, the shapes being hingedly engaged so they can be pivoted toward and away from one another for ease of access to the enclosed stuffing box as desired.

6 Claims, 3 Drawing Sheets

STUFFING BOX LEAK CONTAINMENT APPARATUS

BACKGROUND OF THE INVENTION

When naturally occurring subterranean pressure from gas, water and the like in an oil reservoir has fallen to a point that a well will not produce oil and gas at the earth's surface by way of such natural pressure, some method of artificial lift is necessary to continue producing liquid oil from that well.

A number of artificial lift techniques can be employed in such a situation, one of the most common being downhole pumps employed at the bottom of the well and operated by reciprocation of a string of sucker rods that extend from the downhole pump to the earth's surface and a pumping unit situated thereat. The pumping unit reciprocates the sucker rod string and the downhole pump thereby actuating the pump. Each well is capped at the earth's surface with a wellhead to contain oil that is pumped to the earth's surface and to direct same through a conduit means (connected to the wellhead) to a collection site. The sucker rod string must necessarily extend out the top of the wellhead to reach the pumping unit. A seal means for preventing oil from passing out of the top of the wellhead where the sucker rod string exits is employed. This seal means is conventionally called a stuffing box because of the stuffing therein that is employed to provide a seal around the sucker rod string to prevent oil leakage. In order to get a better seal at the stuffing box the portion of the sucker rod string that reciprocates through the stuffing box is specially coated and polished to give it a smooth surface. That particular section of the sucker rod string is called the polished rod.

If for any reason the well is not pumped for a period of time the polished rod is not reciprocated through the stuffing box and the packing in the stuffing box can sometimes dry out so that when the pumping unit is again actuated oil can leak past the dried out packing and into the atmosphere surrounding the top of the wellhead. If left leaking for a long enough period of time, this can produce a collection of oil on the ground near the base of the wellhead before the packing is again sufficiently wet to provide a good seal against the polished rod.

This invention provides an apparatus whereby normal pumping with the pumping unit and polished rod can be carried on, but the stuffing box is contained in a manner such that any oil leakage therefrom even under pressure will be caught and contained at the wellhead in a manner such that such leakage does not reach the atmosphere or the ground and is caught in an easily disposable manner.

SUMMARY OF THE INVENTION

In accordance with this invention there is provided a liquid collection means which is carried by the wellhead below the stuffing box and which in turn carries in a removable manner at least two separate upstanding hollow shapes, each shape having an open bottom and a closed top and being configured so that when the shapes are brought into abutting relationship with one another the volume enclosed within the abutting shapes encircles the wellhead and extends from the liquid collection means to above the stuffing box and surrounds the polished rod in a manner such that the polished rod can still reciprocate in the stuffing box through the top means of such shapes. The shapes are made removable to the extent that they can be pivoted away from the stuffing box for easy access to the stuffing box for maintenance thereof.

Accordingly, it is an object of this invention is to provide a new and improved leak containment apparatus for a production wellhead. It is another object to provide a new and improved apparatus for enclosing a stuffing box on a wellhead while still allowing for easy access to the stuffing box for maintenance and other purposes. Other aspects, objects and advantages of this invention will be apparent to those skilled in the art from this disclosure and the appended claims.

DETAILED DESCRIPTION OF THE INVENTION

Figure 1:
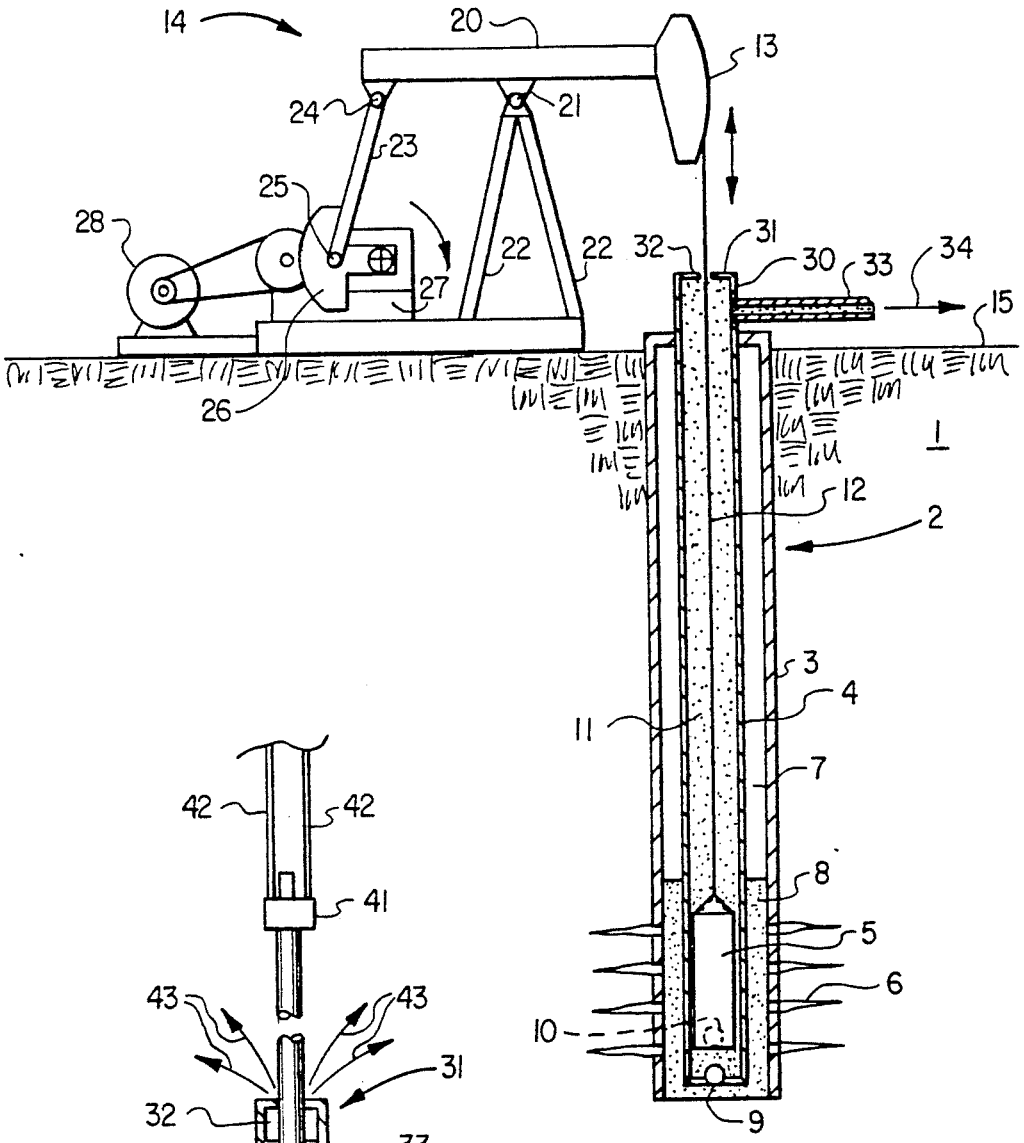
FIG. 1 (PRIOR ART)
FIG. 1 shows a cross-section of a producing oil and gas well having a downhole pump and sucker rod string which is connected to a surface pumping unit.

More specifically, FIG. 1 shows the earth 1 having a wellbore 2 extending downwardly thereinto, wellbore 2 containing casing 3 which lines wellbore 2. Casing 3 contains production tubing 4 therein at the bottom of which is carried downhole pump 5. Perforations 6 in casing 3 allow oil from the oil bearing rock reservoir surrounding perforations 6 and which wellbore 2 penetrates to flow into the annulus 7 between tubing 4 and casing 3 as shown at 8. Oil 8 is then pumped from annulus 7 through check valve 9 by reciprocation of downhole pump 5 and the action of its check valve 10 so that oil is pumped from annulus 7 into the interior of tubing 4 as shown by 11. This pumping action is accomplished by reciprocation of sucker rod string 12 which is connected to downhole pump 5 at its lower end and to horsehead 13 of pumping unit 14 on earth's surface 15.

Pumping unit 14 is composed of a walking beam 20 pivoted at 21 on support means 22. At the rear of walking beam 20 pitman 23 is pivotally connected at 24 to walking beam 20 and at 25 to rotatable crank and counterweight 26. Counterweight 26 is operably connected to gear reducer 27 which is driven by prime mover 28.

Upon operation of prime mover 28 horsehead 13 is reciprocated upwardly and downwardly which in turn reciprocates both sucker rod string 12 and downhole pump 5 to yield the desired pumping action and force oil into tubing 4 and thence to the earth's surface 15 inside wellhead 30. Sucker rod string 12 extends out of the top 31 of wellhead 30 at stuffing box 32 while oil flows from wellhead 30 through conduit means 33 and shown by arrow 34 to remotely located storage, transportation or other disposal means for that oil.

Figure 2:
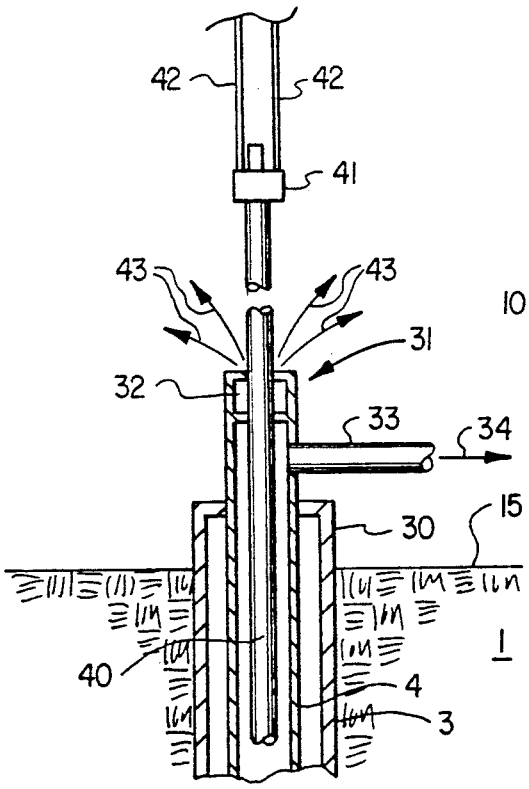
FIG. 2 (PRIOR ART)
FIG. 2 shows a cross-section of a typical well head with its stuffing box and polished rod.

FIG. 2 shows an enlargement of wellhead 30. The section of sucker rod string 12 which continually reciprocates through stuffing box 32 is polished rod 40 which is connected by means of carrier bar 41 to bridle 42 which in turn is connected to horsehead 13. Bridle 42 is flexible wire rope for curving around horsehead 13 when horsehead 13 is at its upper most point of reciprocation. If the conventional packing of stuffing box 32 should become dried out, worn out, or otherwise start to leak oil from inside wellhead 30 to the atmosphere outside and surrounding top 31 of the wellhead as shown by arrows 43, oil can be sprayed into the atmosphere (if sufficient pressure is present within wellhead 30) and/or fall around wellhead 30 down to earth's surface 15.

Figure 3:
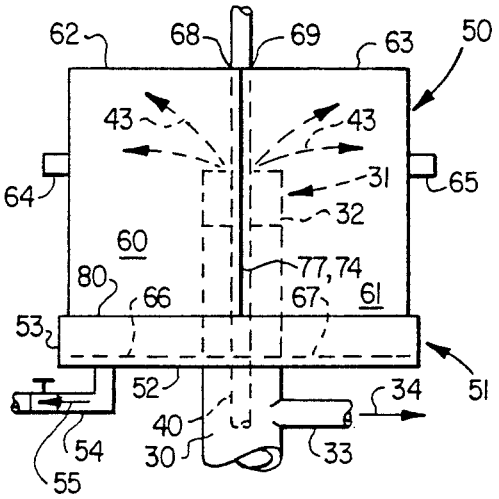
FIG. 3 shows one embodiment of the apparatus of this invention in place on the wellhead of FIG. 2.

FIG. 3 shows the upper portion of wellhead 30 above conduit 33 but below stuffing box 32 to be enclosed in accordance with this invention by an assemblage of at least two separate upstanding hollow shapes 50 which assemblage encircles and encloses stuffing box 32 on all sides except the lower end of the assemblage which is open but rests upon and is closed by liquid collection means 51.

Liquid collection means 51 encircles wellhead 30 and is composed of a closed bottom member 52 and an upstanding side means 53 which also encircles wellhead 30 and which is fixed to bottom member 52 in a liquid tight manner. Bottom member 52 also carries valved drain means 54 so that liquid collected in collection means 51 can be removed therefrom, as shown by arrow 55, for temporary collection in an environmentally safe manner for subsequent disposal. This prevents leaking oil from being allowed to spray into the atmosphere or to flow down wellhead 30 to earth's surface 15.

Figure 4:
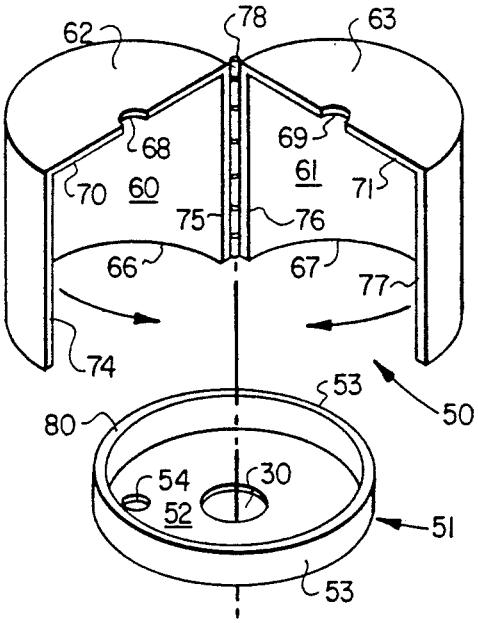
FIG. 4 shows a liquid collection means and upstanding hollow shapes in an exploded view with the hollow shapes open as they would be to provide access to the enclosed stuffing box.
Figure 5:
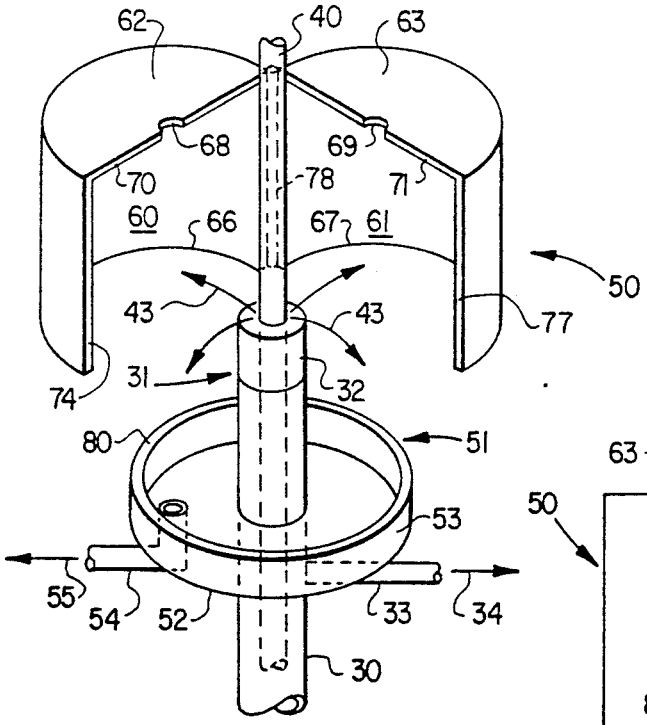
FIG. 5 shows the apparatus of FIGS. 3 and 4 with the hollow shapes in their open configuration.

Assemblage 50 is composed of at least two separate upstanding hollow shapes 60 and 61 each having an open bottom and a closed top means 62 and 63, respectively, which top means 62 and 63 terminate in an apertured edge means 70 and 71 as better shown in FIGS. 4 and 5. Each of shapes 60 and 61 terminate in a pair of opposing upstanding edge means 74 and 77 which are also better shown in FIGS. 4 and 5.

As can be seen from FIG. 3 shapes 60 and 61 are of such horizontal and vertical cross-sectional configuration that when their upstanding edge means 74 and 77 and apertured top edge means 70 and 71 are brought into abutment with one another the volume enclosed within abutting shapes 60 and 61 encircles and encloses wellhead 30 from and within liquid collection means 51 to above stuffing box 32 while the apertured top edge means form an opening that encircles polished rod 4. Each of shapes 60 and 61 carry handle means 64 and 65 for ease of lifting the lowest portion of shapes 60 and 61 (edges 66 and 67 of FIG. 4) out of the interior of liquid collection means 51 so that shapes 60 and 61 can be separated from one another to provide access to the enclosed stuffing box 32 for maintenance and other purposes.

FIG. 4 shows the apparatus of FIG. 3 in exploded view so that it can be seen that liquid collection means 51 encircles wellhead 30 and that assemblage 50 is composed in this embodiment of a pair of curvilinear upstanding right cylindrical segments 60 and 61 which terminate at their lower edges 66 and 67 without any bottom means attached to edges 66 and 67 so that each of shapes 60 and 61 have an open bottom. The cross-sectional configuration of shapes 60 and 61 are such that bottom edges 66 and 67 fit within upstanding side means 53 and rest upon bottom member 52 when in their normally closed and abutting relationship as shown in FIG. 3. In FIG. 4 shapes 60 and 61 are shown in an opened configuration which would be used to provide access to the enclosed stuffing box when desired.

FIG. 4 also shows shapes 60 and 61 to have closed top means 62 and 63 each of which terminates in apertures 68 and 69 and edge means 70 and 71 so that when shapes 60 and 61 are put into their normal abutting, closed relationship as shown in FIG. 3 apertured edge means 70 and 71 will abut one another and apertures 68 and 69 will oppose and match with one another to provide an opening through which polished rod 40 can reciprocate.

Shapes 60 and 61 terminate in a pair of opposing upstanding edge means. For example, shape 60 terminates in opposing upstanding edge means 74 and 75 while shape 61 terminates in opposing upstanding edge means 76 and 77. Conventional hinge means 78 connects upstanding edge means 75 and 76 of shapes 60 and 61 to provide a permanent abutting relationship for edge means 75 and 76. Upstanding edge means 74 and 77 are left unconnected so that shapes 60 and 61 can be swung toward or away from one another by pivoting about hinge means 78. When shapes 60 and 61 are pivoted towards one another until edge means 74 and 77 abut one another the shapes are in their normally closed configuration as shown in FIG. 3 for enclosing and containing the upper portion of wellhead 30 and stuffing box 32, lower edges 60 and 67 in such situation resting upon member 52 to provide a closed bottom by way of liquid collection means 51. Since shapes 60 and 61 fit within side means 53 when in their closed abutting relationship and bottom edges 66 and 67 rest on bottom member 52, liquid 43 even when under pressure is captured within the closed interior volume of assemblage 50 and collected on bottom member 52 within shapes 60 and 61 within side means 53 and is held there in a liquid tight manner until drained from liquid collection means 51 by way of drain means 54.

Hollow shapes 60 and 61 can be of any cross-sectional configuration which accomplishes the foregoing described functions for assemblage 50. Although cylindrical segments are shown for shapes 60 and 61, it is to be understood that any curvilinear shape can be employed, for example, semicircular shapes are equally feasible. In addition, shapes which are angular in cross-section such as square or rectangular can also be employed in this invention as shown hereinafter with reference to FIG. 12.

FIG. 5 shows the apparatus of FIGS. 3 and 4 assembled on wellhead 30 with shapes 60 and 61 moved apart from one another so that unhinged upstanding edge means 74 and 77 are not in abutment with one another as shown in FIG. 3, but rather spaced apart from one another. FIG. 5 further shows shapes 60 and 61 having been lifted out of the interior of liquid collection means 51 and their bottom edge means 66 and 67 rested on upper or top edge 80 of side means 53. The open configuration of FIG. 5 is employed when access to stuffing box 32 is desired. Note that even in this open configuration liquid collection means 51 is operable for collecting any oil that may be flowing down the outside of wellhead 30 from stuffing box 32.

Although it is within this invention to have shapes 60 and 61 completely removable from wellhead 30 it is sometimes desirable to have holding means carried by at least one of wellhead 30 or liquid collection means 51 for fixing hollow shapes 60 and 61 in place in a slidable manner. The slidable manner referred to allows sufficient upward movement of shapes 60 and 61 so that each entire shape can be raised above the top edge 80 side means 53 to facilitate moving hollow shapes 60 and 61 apart from their abutting relationship along one pair of upstanding edge means 74 and 77 as shown in FIG. 5 and to allow resting of bottom edges 66 and 67 on upper edge 80 of side means 53.

Figure 6:
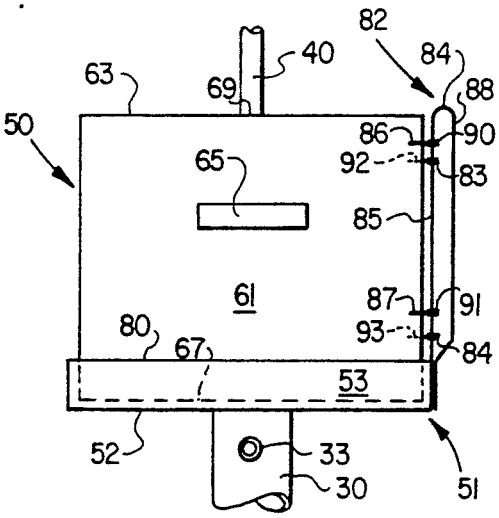
FIGS. 6 and 7 show, respectively, side and back views of the apparatus of FIG. 3 with one embodiment of a holding means for the hollow shapes.

One such holding means within this invention is shown in FIG. 6 to be a closed loop member 82 which carries a plurality of eyes 83 and 84 which slidably encompass and engage first leg 85 of loop member 82. Each eye 83 and 84 carries a support arm 86, 87 which is connected to shape 61. Second leg 88 of loop 82 forms curved top 89 at its upper end and abuts leg 85 at its lower end for rigid attachment of both legs to side means 53 by way of bolting, welding, or the like. Thus, shape 61 when raised upwardly by means of handle 65 can be elevated to top 89 of loop 82 which distance is sized so that at, at least by this point, bottom edge 67 clears top edge 80 for disposition in the open configuration shown in FIG. 5.

Figure 7:
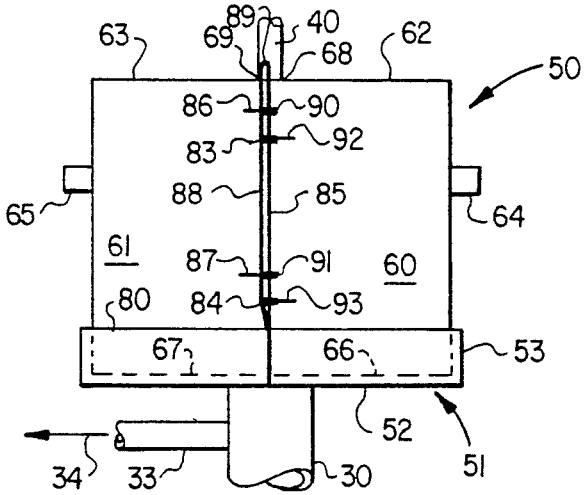

FIG. 7 shows a similar eye/supporting arm arrangement for shape 60 in that eyes 90 and 91 slidably engage loop leg 85 and are rigidly fixed or otherwise connected to shape 60 by supporting arms 92 and 93, respectively.

Figure 8:
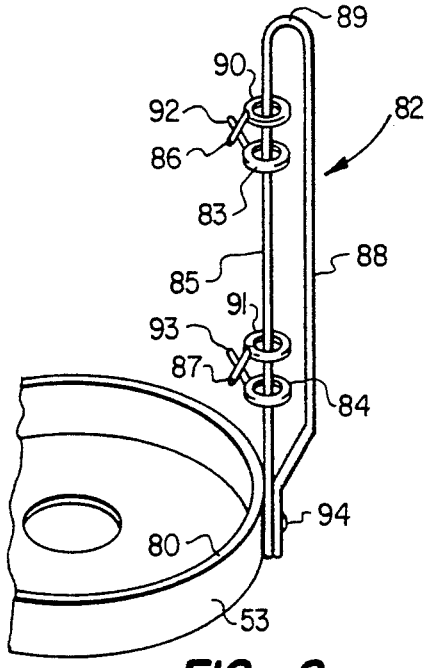
FIG. 8 shows an enlarged view of the holding means of FIGS. 6 and 7.

FIG. 8 shows holding means 82 of FIGS. 6 and 7 in an enlarged view and further shows holding means 82 to be bolted to side means 53 at 94 and legs 85 and 88 and top 89 to be composed of a bent cylindrical rod. Accordingly, it can be seen that eyes 83 and 84 are connected to one hollow shape 61 while the remainder of eyes 90 and 91 by way of their support arms 92 and 93 are apportioned to connecting with the remaining hollow shape 60.

Figure 9:
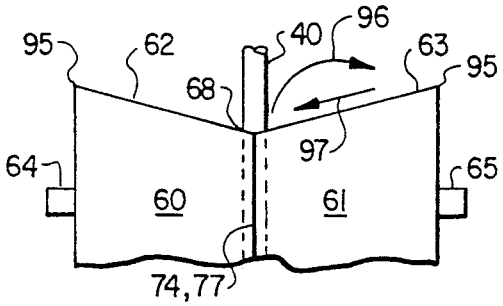
FIG. 9 shows an embodiment of the apparatus of this invention wherein the top members of the hollow shapes are pointed downwardly toward the polished rod.

FIG. 9 shows an embodiment within this invention wherein top members 62 and 63 of shapes 60 and 61 slope downwardly from the upper, outer edge 95 of shapes 60 and 61 to polished rod 40 at terminating apertured edge means 70 and 71. This way any liquid 96 that may escape and collect on top of top means 62 or 63 will gravitate toward polished rod 40 as shown by arrow 97 pass around polished rod 40 and into the interior of shapes 60 and 61 to collect inside liquid collection means 51.

Figure 10:
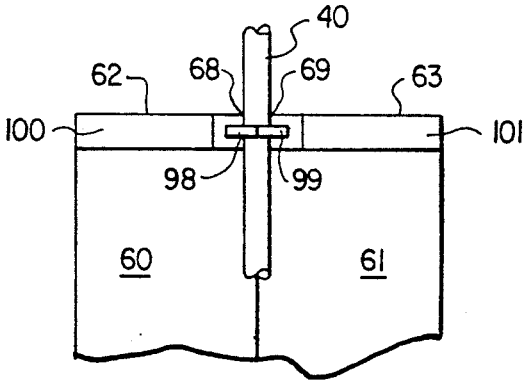

FIG. 10 shows an embodiment within this invention wherein each apertured top edge means 70 and 71 carries shield means 98 and 99. Segments 98 and 99 are fixed in grooved arms 100 and 101 designed to hold segments 98 and 99 in apertures 68 and 69. Segments 98 and 99 can be formed of brass or similar material which is softer than polished rod 40 and which will protect polished rod 40 from scoring by contact of polished rod 40 with edges 70 or 71 of top members 62 and 63 while polished rod 40 reciprocates through apertures 68 and 69.

Figure 11:
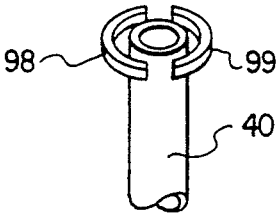
FIGS. 10 and 11 show shield means to protect the polished rod when reciprocating through the top members of the hollow shapes.

FIG. 11 shows segments 98 and 99 to encircle polished rod 40 when those segments are brought into abutting relationship as shown in FIG. 10. This occurs at the same time that the abutting relationship for edges 74 and 77 and edges 70 and 71 takes place as shown in FIG. 3.

Figure 12:
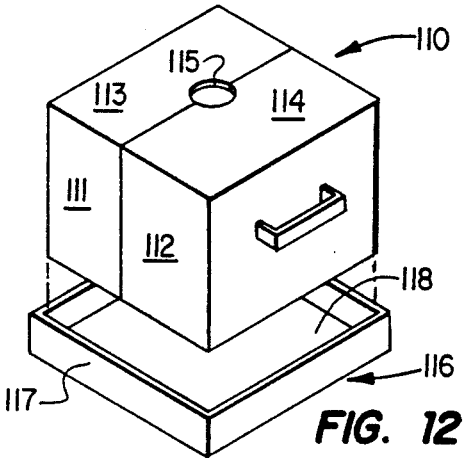
FIG. 12 shows yet another embodiment of hollow shapes within this invention.

FIG. 12 shows an assemblage 110 of a plurality of angular hollow shape 111 and 112 each such shape having an open bottom as shown in FIG. 4 for shapes 60 and 61 and a closed top means 113 and 114 each terminating in an apertured edge means to define an aperture 115 through which polished rod 40 can reciprocate when assemblage 110 is in its normal closed abutting relationship as shown in FIG. 12 and described in detail in respect to FIG. 3. Assemblage 110 would rest in a liquid collection means such as that shown in FIG. 3 at 51 or in an angular liquid collection means that more fits the angular cross-sectional configuration of assemblage 110 as desired. One angular liquid collection means is shown at 116 with its upstanding side means 117 and closed bottom member 118, conventional drain means not being shown.

Reasonable variations and modifications are possible within the scope of this disclosure without departing from the spirit and scope of this invention.

What is claimed:

1. In a production wellhead for a well having a stuffing box through which a polished rod reciprocate when said well is producing fluid, the improvement comprising a liquid collection means carried by said wellhead below said stuffing box, said collection means encircling said wellhead and having a closed bottom member and an upstanding side means which encircles said wellhead and is fixed to said bottom member in a liquid tight manner, said bottom member having drain means operably connected thereto for draining liquid that collects on said bottom member within said side means, at least two separate upstanding hollow shapes each having an open bottom and a closed top means terminating in an apertured edge means, said closed top means of said hollow shapes slant downwardly toward their respective terminating apertured edge means and said polished rod so that any liquid that may collect on top of said top means will gravitate toward said polished rod and pass around said polished rod into the interior of said hollow shapes, each such shape terminating in a pair of opposing upstanding edge means, said shapes being unconnected to and separable from said liquid collection means, said shapes being of such cross-sectional configuration that when their upstanding edge means and apertured top edge means are brought into abutment with one another the volume enclosed within said abutting shapes encircles said wellhead and extends from said bottom member of said collection means to above said stuffing box and said apertured top edge means form an opening that encircles said polished rod, hinge means joining said shapes along one pair of abutting upstanding edge means so said shapes can be pivoted toward and away from one another, whereby said abutting shapes when resting upon said bottom member enclose said stuffing box so that any liquid leakage from said stuffing box even when under pressure is kept contained within said abutting shapes and collected in said liquid collection means while at the same time allowing normal reciprocation of said polished rod in said stuffing box and holding means carried by at least one of said wellhead and said liquid collection means for slidably fixing said hollow shapes in place while allowing sufficient upward movement of said shapes so each entire shape can be raised above said upstanding side means and then moved apart from their abutting relationship along one pair of upstanding edge means to provide access to the stuffing box said shapes enclose when in their normal closed abutting relationship, said holding means being composed of a closed loop member having a plurality of eyes slidably engaging said loop member, each eye carrying a support arm, part of said support arms being connected to one of said hollow shapes and the remainder of said support arms being apportioned between the remainder of said hollow shapes.

2. The apparatus according to claim 1 wherein said hollow shapes are curvilinear in cross-section.

3. The apparatus according to claim 1 wherein said hollow shapes are angular in cross-section.

4. The apparatus according to claim 1 wherein said hollow shapes are semicircular in cross-section.

5. The apparatus according to claim 1 wherein said hollow shapes are square in cross-section.

6. The apparatus according to claim 1 wherein said hollow shapes are rectangular in cross-section.

* * * * *